US005537760A

United States Patent [19]

Sebera

[11] Patent Number: 5,537,760

[45] Date of Patent: Jul. 23, 1996

[54] SYSTEM OF LOW-TEMPERATURE LOW-HUMIDITY PRESERVATION STORAGE AND ACCELERATED RETRIEVAL OF BOOKS AND OTHER PAPERS

[75] Inventor: Donald K. Sebera, Bridgeton, N.J.

[73] Assignee: The United States of America as represented by the Librarian of Congress, Washington, D.C.

[21] Appl. No.: 345,720

[22] Filed: Nov. 22, 1994

[51] Int. Cl.[6] ..... F26B 5/04

[52] U.S. Cl. ..... 34/404; 34/411; 422/40

[58] Field of Search ..... 34/404, 409, 411, 34/412, 92; 422/1, 40

[56] References Cited

U.S. PATENT DOCUMENTS

| | | | |
|---|---|---|---|
| 439,149 | 10/1890 | Heilmann-Ducommun | 34/92 |
| 1,090,971 | 3/1914 | Cilley | 34/92 |
| 2,856,697 | 10/1958 | Fruth | 34/92 |
| 5,264,243 | 11/1993 | Wedinger et al. | 427/140 |

OTHER PUBLICATIONS

Donald K. Sebera, A Graphical Representation of the Relationship of Environmental Conditions to the Permanence of Hygroscopic Materials and Composites, in Proceedings of Conservation in Archives, International Symposium, Ottawa, Canada, May 10–12, 1988, printed in Paris, France, 1989 by International Council on Archives.

*Primary Examiner*—F. Daniel Lopez

[57] ABSTRACT

In a combined system or method for extending the life expectancy of an article of cellulosic material such as a book or other paper, the book or other paper is put in preservation storage at subnormal temperature and subnormal humidity. The resulting loss of flexibility of the paper is remedied upon withdrawal of the book or other paper from storage through its accelerated simultaneous exposure to a partial vacuum of about 5 to 50 torr and to water vapor; a partial vacuum of about 12 to about 30 torr is preferred. This procedure restores both the temperature and moisture content of the paper to normal values.

14 Claims, 1 Drawing Sheet

PRESERVATION STORAGE:

TEMPERATURE BELOW 35°F

AND HUMIDITY BELOW 20%

ACCELERATED RETRIEVAL:

VACUUM BETWEEN 12 AND 30 TORR

HIGH HUMIDITY

PRESERVATION STORAGE:

TEMPERATURE BELOW 35°F

AND HUMIDITY BELOW 20%

FIG. 1

ACCELERATED RETRIEVAL:

VACUUM BETWEEN 12 AND 30 TORR

HIGH HUMIDITY

FIG. 2

SYSTEM OF LOW-TEMPERATURE LOW-HUMIDITY PRESERVATION STORAGE AND ACCELERATED RETRIEVAL OF BOOKS AND OTHER PAPERS

This invention and all United States patent rights thereunder are assigned to the Government of the United States as represented by the Librarian of Congress. The invention described herein may be manufactured and used by or for the Government of the United States of America for Governmental purposes without the payment of any royalties thereon.

BACKGROUND OF THE INVENTION

The modern age has shortened the useful life of books and other papers by two principal sources of degradation: The use of acidic paper of wood pulp origins to print the pages of inexpensive or medium-priced books, and the deleterious effect of air pollution, especially in urban areas where most of the reading public is now concentrated. There exist numerous methods of chemical deacidification of books and other papers, but most of them are either costly or require great skill in their safe application; some of these methods need repeated application.

Preservation of books and other papers by storing them at low temperatures and reduced humidity greatly extends their useful life. However, this method has not been widely used because this type of storage stiffens the paper by substantially reducing its internal moisture content. When such a book or other paper is ordered by a reader, there is an unacceptable waiting period of several days or even weeks between the removal of the book from storage and its safe handling by the reader without inflicting permanent damage to the book pages by permanent creases and potential paper breakage along the crease lines.

The present invention reduces this waiting period to an acceptable period of a few hours by placing the book into a vacuum chamber where it is subjected to a partial vacuum and is simultaneously exposed to enough water vapor to restore the flexibility of the book pages. This procedure simultaneously increases the moisture content and raises the temperature of the paper to normal values.

Book storage at low temperatures retards the pace of the chemical reactions which cause the degradation of paper, but in order to be fully effective in its preservative effect, must be accompanied by lowering the humidity inside the storage chamber, with a resulting decrease in the moisture content of the book pages. The resulting loss of flexibility of the book pages temporarily deprives the book of its usefulness, namely its capability of being read without permanent damage to its pages, until the book regains its pre-storage temperature and moisture content. The use of a partial vacuum and water vapor on a book or other paper being retrieved from low-temperature low-humidity storage in accordance with the present invention provides the library with an effective system of preservation storage while satisfying the reasonable demands of the public for efficient book service without an unacceptable waiting period.

In the course of my duties as a paper chemist in the Preservation Office of the Library of Congress (from which position I have now retired), I presented several years ago an article entitled "A Graphical Representation of the Relationship of Environmental Conditions to the Permanence of Hygroscopic Materials and Composites." The article has been published in the *Proceedings of Conservation in Archives: International. Symposium, Ottawa, Canada*, May 10–12, 1988, printed in Paris: International Council on Archives, 1989. The article recognized and quantified the recognition that storage of books at temperatures and relative humidity well below the human comfort zone greatly extends the useful life of books but also warned that by storage at relative humidities below 20% the paper will become so inflexible as to pose a serious potential for damage in handling.

I made my herein described invention in order to overcome this impediment.

U.S. Pat. No. 5,264,243, Wedinger et al., issued Nov. 23, 1993 to FMC Corporation on an application filed June 16, 1992 discloses a chemical process to deacidify books and other cellulosic materials with certain substituted metal alkoxides applied from a hydrocarbon solution. The foregoing FMC patent also describes, but does not claim, a method of removing the hydrocarbon solvent from the treated books and completing the deacidification reaction by drying the books and repeated applications of a vacuum and water vapor. The FMC patent neither describes nor claims a paper preservation system which includes the use of low-temperature low-humidity storage of books nor does it describe or claim the accelerated restoration of lost flexibility of the book pages upon being removed from storage.

BRIEF SUMMARY OF THE INVENTION

The invention concerns a preservation storage system for extending the life expectancy of a book or other paper or similar article of cellulosic origin, and for the accelerated removal thereof from storage. The book or other paper is put in low-temperature and low-humidity storage. The resulting loss of flexibility of the paper is remedied, upon withdrawal of the book or other paper from storage, by simultaneous exposure to water vapor and a partial vacuum. A partial vacuum of about 5 to 50 torr is adequate; a partial vacuum of about 12 to about 30 torr is preferred. This accelerating procedure restores both the temperature and moisture content of the paper to normal values.

BRIEF DESCRIPTION OF THE DRAWINGS

In the drawings,

FIG. 1 represents the preferred conditions under which the preservation storage step of the invention is carried out.

FIG. 2 represents the preferred range of the partial vacuum employed in the accelerated retrieval step of the invention.

DESCRIPTION OF THE INVENTION

The invention concerns a combined preservation storage system or method for extending the life expectancy of articles of cellulosic origin, such as books and other papers including those of wood pulp origin, and for their accelerated removal from such storage. The books or other papers are placed in low-temperature low-humidity storage, not exceeding about 50° F. and not exceeding about 30% relative humidity. A temperature range of about 25–45° F. is preferred.

Low-temperature preservation storage of books at 35–50° F. and 20–30% relative humidity is suitable as the initial step for the practice of my invention in combination with the subsequent step of accelerated restoration of the paper flexibility by use of a partial vacuum and simultaneous provision of water vapor.

The practice of the present invention also makes it possible to go even below 20% relative humidity during low-temperature storage, inasmuch as the invention solves the problem of accelerated restoration of the flexibility of the book pages upon retrieval of the book from low temperature and low relative humidity.

For optimum preservation I consider storage of books and other papers at or below about 35–45° F. and at or below about 20–25% relative humidity to be a low-temperature low-humidity storage.

The combined effects of storage at or below about 50° F. and artificially produced low humidity of about 25% or less greatly increase the life expectancy (paper permanence) of a book or other paper stored at that temperature. However, without an efficient system of rehydration of the book, when there is demand for same-day or next-day use of the book, such a system of storage is impractical in spite of the beneficial effects of the storage conditions on the life expectancy of the book. This is so because in low-temperature storage at relative humidities of or below about 25% the flexibility of the paper is substantially lost or impaired, and the book cannot be reused in that state without damaging it, e,g., by permanent creases and possible breakage of the paper pages along the crease lines and at page corners and edges. Also, the loss of flexibility of the book pages weakens the effective bond between book pages and the book binding which is normally provided by the glue, threads and staples used in connecting the pages to the binding.

Rehydration by the combined use of water vapor and by a partial vacuum in accordance with the present invention overcomes this handicap and thus makes it possible to adopt a low-temperature book storage system even at relative humidities well below 20%. This rehydration treatment comprises simultaneous exposure of the books to a partial vacuum and to water vapor. This treatment restores the original temperature and the moisture content of the paper to normal values within a few hours.

In accordance with the present invention, books of an average weight of 1 kg can be rehydrated upon retrieval from low-temperature storage at 20 to 25% relative humidity in about 3½ hours or less by the use of water vapor under partial vacuum conditions; the temperature of the books is raised from an initial low temperature of approximately 45° F. or less to a temperature approximating room temperature and the moisture content of the book pages rises from about 3% to about 6%. Generally, there is a temporary temperature rise of about 20° F. in the book pages during rehydration from a dehumidified state for each one-percentage point of water absorbed by the paper.

The foregoing rehydration step is carried out in a vacuum chamber preferably equipped with shelving or equivalent suspension means for supporting the books or other papers being retrieved. It is not necessary or even desirable to create a high vacuum inside the chamber inasmuch as the maintenance of a high vacuum is expensive and does not substantially improve the speed of the rehydration process. A partial vacuum of about 5 torr to about 50 torr is sufficient for purposes of the present invention; a range of about 12 to about 30 torr is preferred. At a partial vacuum with absolute pressure higher than about 50 torr, the water vapor penetration of the pores of the book pages is generally too slow for efficient speed-up of the rehydration process.

Upon reaching the desired partial vacuum inside the chamber, water vapor is admitted to the interior of the chamber by a valve-controlled duct. As the paper gradually absorbs the water vapor, additional water vapor is admitted to the chamber at a steady rate or in increments so as to maintain the desired range of partial vacuum inside the chamber. The water used for the generation of the water vapor is clean water that is substantially free from volatile impurities and, preferably, is non-chlorinated. Optionally, but not necessarily, distilled water may be used.

The books inside the vacuum chamber may be closed to obtain maximum use of the chamber space, or may be open to obtain optimum velocity of penetration of the book pages with water vapor; if the books are open, a fan inside the chamber may be used to keep the pages exposed to the water vapor.

While the principal utility of the above-described system resides in the preservation and retrieval of books, it is also applicable to the preservation and retrieval of other articles comprising cellulosic materials such as papers of wood pulp origin, unbound manuscripts, maps, paper scrolls, and the like.

The following example illustrates the invention but is not intended to limit the scope of the invention to the specific conditions set forth in the example:

EXAMPLE

A book printed on cellulosic paper of mostly wood pulp origin and weighing about 1 kg will be placed in low-temperature and low-humidity preservation storage at about 45° F and about 20% relative humidity, which will reduce the moisture content of its pages to about 3%. Upon removal from this storage, the book will be placed in a vacuum chamber adjusted to an inside temperature of about 77° F. and a partial vacuum of about 12 torr. A continuous supply of water vapor will be admitted to the interior of the vacuum chamber through a controllable duct for about 3 ½ to about 6 hours. The temperature of the book pages will rise slightly above 95° F. and their moisture content will rise to about 6% upon removal of the book from the vacuum chamber. This will restore the flexibility of the book pages. Upon being placed in a room having a temperature of about 65° F. and about 50% relative humidity, the book will quickly cool to slightly above room temperature.

I claim:

1. A library service system, said system comprising a combined method of low-temperature and low-humidity preservation storage of a collection of books having cellulosic paper pages which are flexible at room temperature but are subject to chemical deterioration at said room temperature, and accelerated retrieval of a book selected from said preservation storage, said method including the sequential steps of:

(A) preserving said collection of books in a storage chamber at a low temperature below 45° F. and low relative humidity below 25%, whereby moisture content of said paper pages is reduced to not more than about 3 percent and the chemical deterioration of said paper pages is substantially delayed but the flexibility of said paper pages is substantially impaired so as to preclude non-damaging handling of said books; and (B) upon a library user's demand for a book selected from said collection of books, retrieving said selected book from said preservation storage chamber, subjecting said selected book to a partial vacuum of not less than about 5 torr and simultaneously subjecting said selected book to water vapor to quickly raise the moisture content of said paper pages to not less than about 6 percent and restore the flexibility of said paper pages, so as to permit the non-damaging handling of said selected book by said user.

2. System according to claim 1, wherein said paper pages are of wood pulp origin.

3. Method according to claim 1, wherein said partial vacuum is from about 5 torr to about 50 torr.

4. Method according to claim 6, wherein said preservation storage is below 20% relative humidity.

5. Method according to claim 1, wherein said preservation storage is below 35° F and below 20% relative humidity, and wherein said retrieval from protective storage is at a partial vacuum from about 12 torr to about 30 torr are of wood pulp origin.

6. A library service system, said system comprising a combined method of low-temperature and low-humidity preservation storage of cellulosic papers, said papers being flexible at room temperature but being subject to chemical deterioration at said room temperature, and accelerated retrieval of one or more of said papers from said preservation storage, including the sequential steps of:

(A) preserving said collection of papers in a storage chamber at a low temperature below 45° F. and low relative humidity below 25%, whereby the moisture content of said papers is reduced to not more than about 3 percent and the chemical deterioration of said papers is substantially delayed but the flexibility of said papers is substantially impaired so as to preclude non-damaging handling of said papers, and (B) upon a library user's demand for a paper selected from said collection of papers, retrieving said selected paper from said preservation storage chamber, subjecting said selected paper to a partial vacuum of not less than about 5 torr and simultaneously subjecting said paper to water vapor to quickly raise the moisture content of said paper to not less than about 6 percent and restore the flexibility of said papers, so as to permit the non-damaging handling of said selected papers by said user.

7. System according to claim 6, wherein said papers are of wood pulp origin.

8. Method according to claim 6, wherein said partial vacuum is from about 5 torr to about 50 torr.

9. Method according to claim 6 wherein said preservation storage is below 20% relative humidity.

10. Method according to claim 6, wherein said preservation storage is below 35° F. and below 20% relative humidity, and wherein said retrieval from protective storage is at a partial vacuum from about 12 torr to about 30 torr.

11. System according to claim 6, wherein said papers are unbound manuscripts.

12. System according to claim 6, wherein said papers are maps.

13. System according to claim 6, wherein said papers are scrolls.

14. A library service system, said system comprising a combined method of low-temperature and low-humidity preservation storage of a collection of books having cellulosic paper pages of wood pulp origin which are flexible at room temperature but are subject to chemical deterioration at said room temperature, and accelerated retrieval of at least one selected book from said preservation storage, said method including the sequential steps of:

(A) preserving said collection of books in a storage chamber at a low temperature below 35° F. and low relative humidity below 20%, whereby moisture content of said paper pages is reduced to not more than about 3 percent and the chemical deterioratoin of said paper pages is substantially delayed but the flexibility of said paper pages is substantially impaired so as to preclude non-damaged handling of said books; and (B) upon a library user's demand for a book selected from said collection of books, retrieving said selected book from said preservation storage chamber, subjecting siad selected book to a partial vacuum of not less than about 5 torr and simultaneously subjecting said selected book to water vapor to quickly raise the moisture content of said paper pages to not less than about 6 percent and restore the flexiblity of said paper pages, so as to permit the non-damaging handling of said selected book by said user.

* * * * *

UNITED STATES PATENT AND TRADEMARK OFFICE

CERTIFICATE OF CORRECTION

PATENT NO. : 5,537,760

DATED : July 23, 1996

INVENTOR(S) : Donald K. Sebera

It is certified that error appears in the above-indentified patent and that said Letters Patent is hereby corrected as shown below:

Column 5, line 7,

Claim 4, first line "claim 6" should be -- claim 1 --.

Column 5, line 18,

Claim 6, fifth line, -- the -- should be inserted between "and" and "accelerated."

Column 6, line 32,

Claim 14, nineteenth line, "siad" should be --said--.

Signed and Sealed this

Twenty-sixth Day of November 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,537,760

DATED : July 23, 1996

INVENTOR(S) : Donald K. Sebera

It is certified that error appears in the above-identified patent and that said Letters Patent is hereby corrected as shown below:

Column 5, line 7, Claim 4, first line "claim 6" should be --claim 1--.
Column 5, line 12, Claim 5, fourth line, delete "are of wood pulp origin".
Column 6, line 32, Claim 14, nineteenth line, "siad" should be --said--.

This certificate supersedes Certificate of Correction issued November 26, 1996.

Signed and Sealed this

Twenty-first Day of January, 1997

*Attest:*

Bruce Lehman

BRUCE LEHMAN

*Attesting Officer*

*Commissioner of Patents and Trademarks*